United States Patent [19]

Inamorato

[11] 4,252,664

[45] * Feb. 24, 1981

[54] EFFERVESCENT GRANULES

[75] Inventor: Jack T. Inamorato, Westfield, N.J.

[73] Assignee: Colgate-Palmolive Company, New York, N.Y.

[ * ] Notice: The portion of the term of this patent subsequent to Oct. 30, 1989, has been disclaimed.

[21] Appl. No.: 955,519

[22] Filed: Oct. 30, 1978

Related U.S. Application Data

[60] Continuation of Ser. No. 383,101, Jul. 27, 1973, abandoned, which is a division of Ser. No. 113,674, Feb. 8, 1971, Pat. No. 3,769,224, which is a continuation of Ser. No. 733,280, May 31, 1968, abandoned.

[51] Int. Cl.[3] ..... C11D 7/54

[52] U.S. Cl. ..... 252/99; 252/95; 252/103; 252/106; 252/157; 252/186; 252/350

[58] Field of Search ..... 252/157, 95, 99, 103, 252/186, 350, 106

[56] References Cited

U.S. PATENT DOCUMENTS

| | | | |
|---|---|---|---|
| 2,497,057 | 2/1950 | Pape et al. | 252/157 |
| 3,338,839 | 8/1967 | MacKellar et al. | 252/186 |
| 3,394,083 | 7/1968 | Shen | 252/157 |
| 3,485,761 | 2/1969 | Haxby et al. | 252/110 |
| 3,519,570 | 7/1970 | McCarty | 252/135 |
| 3,769,224 | 10/1973 | Inamorato | 252/99 X |

*Primary Examiner*—Mayer Weinblatt

*Attorney, Agent, or Firm*—Robert L. Stone; Murray M. Grill; Herbert S. Sylvester

[57] ABSTRACT

Granular detergent composition comprising (1) primary granules of one composition (e.g. spray-dried built detergent) and (2) effervescent granules, of a different composition, containing a binder, an acid, a carbonate reactive with the acid, and an "effect material."

1 Claim, No Drawings

EFFERVESCENT GRANULES

This application is a continuation of my copending application Ser. No. 383,101, filed July 27, 1973, now abandoned which is a division of my copending application Ser. No. 113,674 filed Feb. 8, 1971 now U.S. Pat. No. 3,769,224 which is a continuation of my application Ser. No. 733,280 filed May 31, 1968, now abandoned.

This invention relates to granular detergent compositions, particularly suitable for use in clothes-washing machines such as the automatic washers of the type used in the home.

In accordance with one aspect of this invention there is prepared a granular detergent composition containing primary detergent granules of one composition and effervescent granules of a different composition. The effervescent granules comprise a binder, an acid, a carbonate reactive with said acid, and another component herein termed an "effect material". In one preferred form of the invention the primary granules are the products of a spray-drying operation and the effect material which is carried in or by the effervescent granules, is a material which is sensitive to the conditions of high temperature and high water content that prevail during spray drying and during the necessary preparation for spray drying.

The binder used in making effervescing granules is preferably a fusible normally solid material. Among the materials which may be used are higher fatty acids (e.g. decanoic, lauric, myristic, or stearic acid or hydrogenated fish fatty acid (of, e.g. 16–22 carbon atoms) or mixtures thereof), polyalkylene glycols (e.g. polyethylene glycols), non-ionic detergents (e.g. polyethoxylation products made by reacting ethylene oxide with a fatty alcohol, fatty acid, fatty amine, alkyl phenol or fatty amide, amides (e.g. fatty amides such as the monoethanolamide, diethanolamide or isopropanolamide of a higher fatty acid)).

The binder may be a water-soluble material or a water-insoluble material which fuses at the temperature of the wash water or a water-insoluble material which (like the fatty acids) forms a water-soluble or readily dispersible salt (e.g. a soap) in contact with alkali in the presence of water. The proportion of binder in the effervescent granules is preferably at least 5%, e.g. about 10, 15, 20, 30, 40, or 50%. The rate of effervescence and breaking up of the granules may be controlled by choice of the character and quantity of the binder. For example, the use of a higher melting hydrophobic binder (e.g. a paraffin wax or a higher fatty alcohol) will give a slower rate. In any event because of the effervescence the granules break up and release their effect materials more rapidly than would be the case if the effervescence, owing to the presence of the gas-producing agent, did not take place.

The gas-producing agent is preferably a carbonate, most desirably sodium carbonate or sodium bicarbonate, in admixture with an acid, preferably a solid acid. Examples of suitable acids are fatty acids (which, as previously mentioned, serve also as binders); inorganic acids such as boric acid, alkali metal acid phosphates, alkali metal acid sulfates or other acidic salts; or other organic acids such as citric, oxalic tartaric or benzoic acid. The proportion of acid in the mixture is preferably at least 5%, e.g. about 10, 15, 20, 30 or 40%. The proportion of the carbonate in the granules is preferably at least 5%, e.g. about 10, 15, 20, 30, 40, 50 or 60%. The carbonate and acid need not be present in stoichiometric proportions. Good effervescent properties have been obtained over a wide range of proportions.

The invention is of particular utility when the effervescent granules contain "effect materials" which have relatively poor stability when blended and stored with ordinary spray-dried detergent compositions. Among such effect materials are solid bleaching agents including sources of hypochlorite chlorine such as the chloroisocyanuric compounds (which can also adversely affect the perfume used in the detergent composition), and enzyme preparations such as those containing proteolytic enzymes.

Also, the effervescent granules may contain effect materials, which although stable in contact with ordinary spray-dried detergent compositions, are adversely affected by certain ingredients in special detergent compositions. For example, certain fluorescent brighteners of the type which are sensitive to particular bleaching agents (e.g. of the naphthotriazole stilbene sulfonate type, such as Geigy "Tinopal RBS-200%" which degrades on prolonged contact with certain chloroisocyanuric bleaching compounds) may be protected, in detergent compositions containing such bleaching agents, by putting the brightener in the effervescent granules. Thus, effervescent granules containing a bleach-sensitive fluorescent brightener may be added to a water-sensitive granular detergent composition comprising solid potassium dichloroisocyanurate and an alkaline builder salt, the whole being packaged in a sealed container such as a water-soluble polyvinyl alcohol packet designed for addition (with detergent) to the water in an automatic clothes-washing machine. In this use the effervescent granules may also contain a bleach booster, such as sodium bromide.

The effervescent granules are also useful when they contain other effect materials utilized in detergent compositions, such as bleach boosters, bacteriostatic and bactericidal agents, fluorescent brighteners, bluing agents, activators for sodium perborate.

Examples of bacteriostatic and bactericidal agents are halogenated carbanilides, e.g. trichlorocarbanilide, halogenated salicylanilide, e.g. tribromosalicylanilide, halogenated bis-phenols, e.g. hexachlorophene, halogenated trifluoromethyldiphenyl urea, zinc salt of 1-hydroxy-2-pyridinethione and the like.

Examples of fluorescent brighteners are stilbene sulfonate brighteners such as naphthotriazole stilbene sulfonates, bis (anilino diethanolamino triazinyl) stilbene disulfonic acid, sodium bis (anilino morpholino triazinyl) stilbene disulfonate, and oxazole brighteners such as those having a 1-phenyl 2-benzoxazole ethylene structure.

Proteolytic enzymes are active upon protein matter and catalyze digestion or degradation of such matter when present as in linen or fabric stain in a hydrolysis reaction. The enzymes are effective at a pH range of about 4–12, such as usually prevails in detergent cleaning procedures. Moreover, they may be effective even at moderately high temperatures so long as the temperature does not degrade them. Some proteolytic enzymes are effective at up to about 80° C. and higher. They are also effective at ambient temperature and lower to about 10° C. Particular examples of proteolytic enzymes which may be used in the instant invention include pepsin, trypsin, chymotrypsin, papain, bromelin, colleginase, keratinase, carboxylase, amino peptidase, elastase, subtilisia and aspergillopepidase A and B. They are available also under names such as Alcalase (Novo Industri, Copenhagen, Denmark), Monzyme (Monsanto Chemical Co.), Maxatase (Royal Netherlands Fermentation, Delft, Netherlands), Protease AP (Sandoz-Ferment, Basle, Switzerland), Protease B-400 (Sandoz-Ferment), Protease ATP 40 (Sandoz-Ferment), Pancreatin NF (Pfizer), Pancreatin 6xNF (Armour), Fungal Protease (Miles), DSE Numbers 4–9 (Rohm and Haas), Exzyme DPX (Premier Malt), Protease L-252 Digester (Premier Malt), Protease L-253 Digester (Premier Malt), Protease I-423 (Premier Malt), Protease L-516 (Premier Malt), Protease L-517 (Premier Malt), Texzyme PX-1 (Premier Malt), Protease P-G (Pfizer), Compound 37B (Miles), Serizyme (Wallerstein), Papain 100 (Wallerstein), Optimo Papain (Penick), Ficin (Miles), Bromelain (Miles), HT Proteolytic Concentrate (Miles), Protease ATP 40 (Rapidase), Protease ATP 120 (Rapidase), Rhozyme P-11 (Rohm and Haas) and Rhozyme PF (Rohm and Haas).

Proteolytic enzymes such as Alcalase, Maxatase, Protease AP, Protease ATP 40, Protease ATP 120, Protease L-252 and Protease L-423 are derived from strains of spore foaming bacillus, such as bacillus subtillis.

Different proteolytic enzymes have different degrees of effectiveness in aiding in the removal of stains from textiles and linen. Particularly preferred as stain removing enzymes are Alcalase, Maxatase, Protease AP, Protease ATP 40, and Rapidase.

Metalloproteases which contain divalent ions such as calcium, magnesium or zinc bound to their protein chains are of interest.

Examples of solid bleaching agents are water-soluble dry solid materials which generate hypochlorite ion on contact with, or dissolution in, water. Examples thereof are the dry, particulate heterocyclic N-chloro imides such as trichloroisocyanuric acid, and dichloroisocyanuric acid and salts thereof such as sodium dichloroisocyanurate and potassium dichloroisocyanurate. Other imides may also be used such as N-chlorosuccinimide, N-chloromalonimide, N-chlorophthalimide and N-chloronapthalimide. Additional suitable imides are the hydantoins such as 1,3-dichloro 5,5 dimethyl hydantoin; N-monochloro-5,5-dimethylhydantoin; methylene-bis(N chloro-5,5-dimethylhydantoin); 1,3-dichloro-5-methyl-t-n-amylhydantoin, and the like. Other useful hypochlorite-liberating agents are trichloromelamine, N,N-dichlorobenzoylene urea, N,N-dichloro-p-toluenesulfonamide and dry, particulate, water soluble anhydrous inorganic salts such as lithium hypochlorite and calcium hypochlorite.

The perborate activators which may be used are a well known class of materials, described for example in a series of articles by Gilbert in Detergent Age, June 1967, Pages 18–20; July 1967, Pages 30–33; and August 1967, Pages 26, 27 and 67. The perborate activators of greatest importance in the practice of this invention are compounds which are percarboxylic acid precursors such as esters and anhydrides and acyl amides. Examples of suitable activators are given by Gilbert who also describes a test for suitability, and any of those activators may be used in the present invention. Another specific highly effective activator is m-chlorobenzoyldimethylhydantoin. The activator may be present in the effervescent granule which is then mixed with granules of detergent composition containing the sodium perborate.

One convenient process for making the effervescent granules is to dry-blend the ingredients in finely divided form; then heat the blend to fuse the binder; continue mixing the resulting slurry; solidify the blend, as by cooling; and form solid granules of the blend before, during or after the solidification step. The binder may also be separately fused and then mixed with the other ingredients to form a slurry, or the fused binder may be sprayed onto an agitated mixture of the other ingredients so that agglomeration takes place. The slurry may be subdivided by dropping it onto a chilled drum and breaking up the resulting solid, or it may be sprayed into a cooled tower, forming separate particles which solidify in the tower, or it may be distributed over the surface of a screen having apertures of the desired size and forced through those apertures.

To produce effervescent granules of low density there may be included therein expanded porous components of low bulk specific gravity, such as the material known as "puffed borax" which may be produced by heating particles of hydrated sodium tetraborate (e.g. decahydrate or pentahydrate) in hot air to drive off part of the water of hydration. Other expanded salts, such as puffed hydrated pentasodium tripolyphosphate, may be employed. The borax and tripolyphosphate are known builder salts in detergent compositions.

The rate of effervescence of the preferred granules of this invention is rather low. The granules do not "fizz," or otherwise effervesce violently, when dropped into water at the washing temperature. The action is gradual and, in quiescent water (at say 35°–60° C.), it takes at least several seconds (usually, more than five or ten seconds) before the particles start to break up. Often one or more gas bubbles become visible at the surface of a particle in the water and some or all of the particles, originally more dense than the water, begin to rise in the water after a short time. Of course, if one wishes one can by changing the types of ingredients, in the light of the teachings of this application, greatly increase the rate of effervescence.

The sizes of the effervescent granules may be varied, e.g. in the range of about 0.2 to 3 mm; in a preferred type a major proportion, e.g. 80% or more by weight, of the granules have particle diameters between 0.25 and 0.9 mm. The particle sizes of the carbonate effect material and other ingredients that are blended with the binder are generally considerably smaller than the sizes of the granules; it is preferred to use fine powders of these ingredients.

Typical granular spray-dried detergent compositions with which the effervescent granules of this invention may be blended generally contain organic surface-active detergents and builder salts. The spray-dried compositions may be in granular form, e.g. they may be hollow beads or aggregates of such beads. One suitable method of making spray-dried detergent compositions, and a description of the components thereof, is found in Monick U.S. Pat. No. 3,055,835.

The apparent density of the spray-dried particles is generally less than about 0.42 g/cc, e.g. in the range of about 0.32 to 0.38 g/cc, and the moisture content of those particles is generally in the range of about 3 to 13%, preferably about 4 to 12%, e.g. 7 to 10%. Generally their diameters will be at least about 0.15 mm, preferably at least about 0.25 mm (retained on a 60-mesh screen).

The organic detergent may be a surface-active agent of the anionic, non-ionic, amphoteric or cationic type, or a mixture of such types.

The anionic surface active agents include those surface active or detergent compounds which contain an organic hydrophobic group and an anionic solubilizing group. Typical examples of anionic solubilizing groups are sulfonate, sulfate, carboxylate, phosphonate and phosphate. Examples of suitable anionic detergents which fall within the scope of the invention include the soaps, such as the water-soluble salts of higher fatty acids or rosin acids, such as may be derived from fats, oils and waxes of animal, vegetable origin, e.g. the sodium soaps of tallow, grease, coconut oil, tall oil and mixtures thereof; and the sulfated and sulfonated synthetic detergents, particularly those having about 8 to 26, and preferably about 12 to 22 carbon atoms to the molecule.

As examples of suitable synthetic anionic detergents there may be cited the higher alkyl mononuclear aromatic sulfonates such as the higher alkyl benzene sulfonates containing from 10 to 16 carbon atoms in the alkyl group in a straight or branched chain, e.g., the sodium salts of higher alkyl benzene sulfonates or of the higher alkyl toluene, xylene and phenol sulfonates; alkyl naphthalene sulfonate, ammonium diamyl naphthalene sulfonate, and sodium dinonyl naphthalene sulfonate. In one preferred type of composition there is used a linear alkyl benzene sulfonate having a high content of 3-(or higher) phenyl isomers and a correspondingly low content (well below 50%) of 2- (or lower) phenyl isomers, in other terminology, the benzene ring is preferably attached in large part at the 3 or higher (e.g. 4, 5, 6 or 7) position of the alkyl group and the content of isomers in which the benzene ring is attached at the 2 or 1 position is correspondingly low. Particularly preferred materials are set forth in U.S. Pat. No. 3,320,174, May, 16, 1967, of J. Rubinfeld.

Other anionic detergents are the olefin sulfonates, including long chain alkene sulfonates, long chain hydroxyalkane sulfonates or mixtures of alkenesulfonates and hydroxyalkanesulfonates. These olefin sulfonate detergents may be prepared, in known manner, by the reaction of $SO_3$ with long chain olefins (of 8–25, preferably 12 to 21 carbon atoms) of the formula $RCH{=}CHR_1$, where R is alkyl and $R_1$ is alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (e.g. sodium bisulfite), e.g. primary paraffin sulfonates of about 10–20, preferably about 15–20, carbon atoms such as the primary paraffin sulfonates made by reacting long chain alpha olefins and bisulfites (e.g. sodium bisulfite) or paraffin sulfonates having the sulfonate groups distributed along the paraffin chain such as the products made by reacting a long chain paraffin with sulfur dioxide and oxygen under ultraviolet light followed by neutralization with NaOH or other suitable base (as in U.S. Pat. Nos. 2,503,280; 2,507,088; 3,260,741; 3,372,188 and German Pat. No. 735,096); sulfates of higher alcohols; salts of $\alpha$-sulfofatty esters (e.g. of about 10 to 20 carbon atoms, such as methyl $\alpha$-sulfo-myristate or $\alpha$-sulfotallowate).

Examples of sulfates of higher alcohols are sodium lauryl sulfate, sodium tallow alcohol sulfate. Turkey Red Oil or other sulfated oils, or sulfates of mono- or di-glycerides of fatty acids (e.g. stearic monoglyceride monosulfate), alkyl poly(ethenoxy)ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly(ethenoxy)ether sulfates such as the sulfates of the condensation products of ethylene oxide and nonyl phenol (usually having 1 to 6 oxyethylene groups per molecule).

The suitable anionic detergents include also the acyl sarcosinates (e.g. sodium lauroylsarcosinate) the acyl esters (e.g. oleic acid ester) of isethionates, and the acyl N-methyl taurides (e.g. potassium N-methyl lauroyl- or oleyl tauride).

The most highly preferred water soluble anionic detergent compounds are the ammonium and substituted ammonium (such as mono-, di- and triethanolamine), alkali metal (such as sodium and potassium) and alkaline earth metal (such as calcium and magnesium) salts of the higher alkyl benzene sulfonates, olefin sulfonates, the higher alkyl sulfates, and the higher fatty acid monoglyceride sulfates. The particular salt will be suitably selected depending upon the particular formulation and the proportions therein.

Nonionic surface active agents include those surface active or detergent compounds which contain an organic hydrophobic group and a hydrophilic group which is a reaction product of a solubilizing group such as carboxylate, hydroxyl, amido or amino with ethylene oxide or with the polyhydration product thereof, polyethylene glycol.

As examples of nonionic surface active agents which may be used there may be noted the condensation products of alkyl phenols with ethylene oxide, e.g., the reaction product of isooctyl phenol with about 6 to 30 ethylene oxide units; condensation products of alkyl thiophenols with 10 to 15 ethylene oxide units; condensation products of higher fatty alcohols such as tridecyl alcohol with ethylene oxide; ethylene oxide addends of monoesters of hexahydric alcohols and inner ethers thereof such as sorbitan monolaurate, sorbitol monooleate and mannitan monopalmitate, and the condensation products of polypropylene glycol with ethylene oxide.

Cationic surface active agents may also be employed. Such agents are those surface active detergent compounds which contain an organic hydrophobic group and a cationic solubilizing group. Typical cationic solubilizing groups are amine and quaternary groups.

As examples of suitable synthetic cationic detergents there may be noted the diamines such as those of the type $RNHC_2H_4NH_2$ wherein R is an alkyl group of about 12 to 22 carbon atoms, such as N-2-aminoethyl stearyl amine and N-2-aminoethyl myristyl amine; amide-linked amines such as those of the type $R^1CONHC_2H_4NH_2$ wherein $R^1$ is an alkyl group of about 9 to 20 carbon atoms, such as N-2-amino ethylstearyl amide and N-amino ethyl myristyl amide; quaternary ammonium compounds wherein typically one of the groups linked to the nitrogen atom is an alkyl group of about 12 to 18 carbon atoms and three of the groups linked to the nitrogen atom are alkyl groups which contain 1 to 3 carbon atoms, including such 1 to 3 carbon alkyl groups bearing inert substituents, such as phenyl groups, and there is present an anion such as halogen, acetate, methosulfate, etc. Typical quaternary ammonium detergents are ethyl-dimethyl-stearyl ammonium chloride, benzyl-dimethyl-stearyl ammonium chloride, benzyl-diethyl-stearyl ammonium chloride, trimethyl stearyl ammonium chloride, trimethyl-cetyl ammonium bromide, dimethyl-ethyl dilauryl ammonium chloride, dimethyl-propyl-myristyl ammonium chloride, and the corresponding methosulfates and acetates.

Examples of suitable amphoteric detergents are those containing both an anionic and a cationic group and a hydrophobic organic group, which is advantageously a higher aliphatic radical, e.g. of 10–20 carbon atoms. Among these are the N-longchain alkyl aminocarboxylic acids (e.g. of the formula $$R-\overset{\overset{R_2}{|}}{N}-R'-COOM);$$

the n-long chain alkyl iminodicarboxylic acids (e.g. of the formula $RN(R'COOM)_2$) and the N-long chain alkyl betaines (e.g. of the formula $$R-\overset{\overset{+R_3}{|}}{\underset{\underset{R_4}{|}}{{}^{+}N}}-R'-COO^{-})$$

where R is a long chain alkyl group, e.g. of about 10–20 carbons, R' is a divalent radical joining the amino and carboxyl portions of an amino acid (e.g. an alkylene radical of 1–4 carbon atoms), M is hydrogen or a salt-forming metal, $R^2$ is a hydrogen or another monovalent substituent (e.g. methyl or other lower alkyl), and $R^3$ and $R^4$ are monovalent substituents joined to the nitrogen by carbon-to-nitrogen bonds (e.g. methyl or other lower alkyl substituents). Examples of specific amphoteric detergents are N-alkyl-beta-aminopropionic acid; N-alkyl-beta-iminodipropionic acid, and N-alkyl, N,N-dimethyl glycine; the alkyl group may be, for example, that derived from coco fatty alcohol, lauryl alcohol, myristyl alcohol (or a lauryl-myristyl mixture), hydrogenated tallow alcohol, cetyl, stearyl, or blends of such alcohols. The substituted aminopropionic and iminodipropionic acids are often supplied in the sodium or other salt forms, which may likewise be used in the practice of this invention. Examples of other amphoteric detergents are the fatty imidazolines such as those made by reacting a long chain fatty acid (e.g. of 10 to 20 carbon atoms) with diethylene triamine and monohalocarboxylic acids having 2 to 6 carbon atoms, e.g. 1-coco-5-hydrox-ethyl-5-carboxymethylimidazoline; betaines containing a sulfonic group instead of the carboxylic group; betaines in which the long chain substituent is joined to the carboxylic group without an intervening nitrogen atom, e.g. inner salts of 2-trimethylamino fatty acids such as 2-trimethylaminolauric acid, and compounds of any of the previously mentioned types but in which the nitrogen atom is replaced by phosphorus.

Examples of water-soluble builder salts which may be used, particularly when heavy duty cleaning is desired, include phosphates and particularly condensed phosphates (e.g. pyrophosphates or tripolyphosphates), silicates, borates and carbonates (including bicarbonates), as well as organic builders such as salts of nitrilotriacetic acid or ethylene diamine tetraacetic acid. Sodium and potassium salts are preferred. Specific examples are sodium tripolyphosphate, potassium pyrophosphate, sodium hexametaphosphate, sodium carbonate, sodium bicarbonate, sodium sesquicarbonate, sodium tetraborate, sodium silicate, salts (e.g. Na salt) of methylene diphosphonic acid, trisodium nitrilotriacetate, disodium diglycollate, or mixtures of such builders, including mixtures of pentasodium tripolyphosphate and trisodium nitrilotriacetate in a ratio, of these two builders, of 1:10 to 10:1, e.g. 1:1. The proportions of builder salt may be, for example, 50 parts or more (e.g. 50 to 1000 parts) per 100 parts of detergent.

The invention has found its greatest utility thus far in the washing of cotton fabrics, but it may be used with fabrics made of other cellulosic fibers, e.g. rayon, or other textile fibers, e.g. nylon, silk, wool, polyethylene terephthalate, cellulose acetate, acrylonitrile polymers or copolymers, or blends of any two or more of these fibers (e.g. cotton-polyester blends).

The following Examples are given to illustrate this invention further. Unless otherwise noted, all proportions in the Examples and in the rest of the application are by weight, and numbers in tabulations represent parts by weight.

EXAMPLE 1

In four experiments the ingredients, and their proportions, are those tabulated below:

| | A | B | C | D |
|---|---|---|---|---|
| $NaHCO_3$ | 2.0 | 2.0 | 1.5 | 1.5 |
| Decanoic acid | 0.5 | | 0.5 | |
| Lauric acid | | 0.5 | | 0.5 |
| $KH_2PO_4$ | | | 0.5 | 0.5 |
| Sodium bromide | 0.5 | 0.5 | 0.5 | 0.5 |
| Ultramarine blue | 0.2 | 0.2 | 0.2 | 0.2 |

The ingredients are mixed well and heated until the fatty acid melts. The mixture is stirred well and then allowed to stand and cool. A solid forms in each case. Each solid is then mechanically broken up into small particles (e.g. of about 3 mm diameter or less). In each case, when the particles are placed in water at 37° C. they gradually begin to effervesce and break up. Often one or more gas bubbles become visible at the surface of a particle and the particle, or a portion thereof, originally more dense than the water, begins to rise in the water, after it has been in the water about a minute or more. The particles containing the mono-basic potassium phosphate (formulations C and D above) effervesce at a much faster rate than the others, but here too the action is not violent.

On storage in an open vessel at room temperature for more than three months the particles are found to be stable and retain their effervescing properties.

EXAMPLE 2

The following formulation is formulated into particles in the manner described in Example 1: 5 parts of the $NaHCO_3$, 2 parts of the lauric acid, 2 parts of the $KH_2PO_4$, 3 parts of anhydrous powdered potassium dichloroisocyanurate, and 0.3 parts of the ultramarine blue. When tested in warm water the particles behave as in Example 1 and liberate hypochlorite chlorine as evidenced by the odor of the water.

10 parts of the particles are blended with 9 parts of a granular spray dried built detergent composition having a particle size of about 40–60 mesh (particle diameter about 0.25–0.4 mm), containing 10% sodium linear tridecylbenzenesulfonate; 2% of the ethoxylation product made from ethylene oxide and primary alkanols of C14-C15 chain length, the ethoxylation product containing 11 mols of oxyethylene per mol of alkanol; 2% of sodium soap of a mixture of 3 parts of tallow fatty acids and 1 part of coconut oil fatty acids; about 8.5% total moisture; 34% of phosphate solids (from pentasodium tripolyphosphate); 7% of sodium silicate solids ($Na_2O:SiO_2$ mol ratio 1:2.35); 0.15% of ultramarine blue; 0.5% of sodium carboxymethyl cellulose; 0.2% of water-soluble polyvinyl alcohol; 0.44% of fluorescent brighteners and the balance sodium sulfate and a little perfume.

The blend is used for the washing of cloth, using 0.15% of the blend in water at 120° F. It is found to be an effective detergent and bleach.

EXAMPLE 3

In two experiments the ingredients, and their proportions, are those tabulated below:

| | A | B |
|---|---|---|
| $NaHCO_3$ | 4.0 | 3.25 |
| Myristic acid | 1.75 | 1.5 |
| Lauric acid | 1.75 | 1.5 |
| $KH_2PO_4$ | 2.0 | 1.75 |
| Brightener | 0.5 | |
| Potassium dichloroisocyanurate ("KDCC") | | 2.0 |

The brightener is sodium bis(anilino morpholino triazinyl)stilbene disulfonate.

In each case the ingredients are blended together and then heated until the fatty acid melts. The resulting melt is thoroughly mixed and then poured slowly onto a screen (#14 U.S. Standard, having 1.4 mm openings) allowed to cool slightly and then worked through the screen with a spatula. Fines are then removed from the screened, cooled particles by sieving them through another screen (#20 U.S. Standard, having 0.84 mm openings).

The particles are found to effervesce, as in Example 1, in water at 30° C. and 37° C. Washing tests show that the particles of Example 3A brighten cotton cloth and the particles of Example 3B bleach cotton cloth. 1.6 parts of the particles of Example 3A are mixed with 34.92 parts of a granular built detergent formulation and 1 part of the KDCC powder described above. Also 5 parts of the particles of Example 3B are mixed with 34.92 parts of the same built detergent formulation and 0.08 parts of the brightener powder described above. In each case the resulting mixture is used in the washing of cotton fabric for 10 minutes in Jersey City tap water (whose hardness is about 100 ppm) at 25° C. using a 0.15% concentration of the mixture in the wash water.

The built detergent formulation used above has the following composition: 21% sodium linear tridecylbenzenesulfonate, 35% pentasodium tripolyphosphate, 8.5% total moisture, 7% sodium silicate and the balance sodium sulfate and a small amount of perfume.

EXAMPLE 4

Following the procedure of Example 3, effervescent particles are made from the following two formulations:

| | A | B |
|---|---|---|
| $NaHCO_3$ | 22 | 5 |
| Lauric acid | 10 | 2.5 |
| $KH_2PO_4$ | 20 | 4 |
| Sodium bromide | 10 | 0.5 |
| KDCC | 4 | 4 |

-continued

| | A | B |
|---|---|---|
| Polar Brilliant Blue (pigment) | 1 | |

5 parts of product A are blended with 95 parts of the spray dried built commercial detergent described in Example 2. After 6 months of storage in an open vessel the product retains its effervescent properties.

EXAMPLE 5

In a study of the effect of variations in the binder the following two formulations are prepared:

| | A | B |
|---|---|---|
| $NaHCO_3$ | 11 | 10 |
| $KH_2PO_4$ | 10 | 9 |
| NaBr | | 2 |
| Polyethylene glycol | 5 | |
| Petroleum wax | | 5 |
| Fluorescent dye | 0.1 | 0.1 |

The polyethylene glycol is Carbowax 1540, a normally solid water-soluble product whose molecular weight is about 1500 and whose melting point range is about 37°–43° C. The petroleum wax melts at about 36° C.

In each case, the ingredients are all blended together and then heated until the binder melts and a slurry is formed. The slurry is stirred and spread out on a flat dry surface to cool and harden after which the solid is broken up and forced through a #10 U.S. Standard screen. In tests in water at 27° C. Product A (made with the polyethylene glycol) effervesces but Product B (made with the petroleum wax) does not show effervescence in a reasonable time, until the temperature of the water is raised to 55° C. 5 parts of Product A are blended with 95 parts of the granular spray dried built commercial detergent described in Example 2.

EXAMPLE 6

Following the procedure of Example 3 effervescent granules are made from a mixture of the following dry ingredients: the lauric acid, 20.9 parts; the $NaHCO_3$, 15.0 parts; the $KH_2PO_4$, 10.0 parts; the KDCC, 10.0 parts; puffed borax, 10.0 parts. The puffed borax is made by heating particles of either borax or sodium tetraborate pentahydrate to drive off water and expand the particles in known manner; the puffed borax used in this Example has a bulk specific gravity of about 0.3 and 65% of its weight is of 20–40 mesh particle size (particle diameters about 0.4 to 0.84 mm.).

The resulting granules are highly effective as bleaching agents.

On aging for several days at 90° F. and 60% RH the formulation retains its effervescent and bleaching properties.

Part (e.g. one half) of the puffed borax in this Example may be replaced by other builder salts such as pentasodium tripolyphosphate.

EXAMPLE 7

Using the procedure of Example 5 effervescent granules are made from the following mixtures:

| | A | B |
|---|---|---|
| $NaH_2PO_4 \cdot H_2O$ | 2 | 2 |

-continued

| | A | B |
|---|---|---|
| $NaHCO_3$ | 2 | 2 |
| Proteolytic enzyme preparation | 2 | 2 |
| Puffed borax, of 0.3 bulk specific gravity | 4 | |
| Dry non-ionic detergent | 4 | |
| Polyethylene glycol | | 4 |

The proteolytic enzyme preparation is a green product sold as "Protease" by Premier Malt; its assay is 60,000 PV units per gram (the PV unit is a known unit of enzyme activity and is related to the quantity of enzyme which digests 1 mg of casein to the standard turbidity endpoint in 1 hour at 37° C. at pH 7; see the Gross-Field method described in Tauber, Chemistry and Technology of Enzymes, 1949, Page 181).

The non-ionic detergent is a solid product of the polyethoxylation of a mixture of long chain alkanols of 12 to 15 carbon atoms, containing an average of 30 ethylene oxide units per molecule of alkanol. Its melting range is 38°-46° C.

The polyethylene glycol is a water-soluble solid sold as "Carbowax 1000" having an average molecular weight of about 1000 and a melting range of 33°-40° C.

Each of these granular preparations is suitable for mixing with a spray dried commercial detergent preparation to increase the effectiveness of the latter on proteinaceous stains.

EXAMPLE 8

Following the procedure of Example 5, effervescent granules are made from the following mixture: lauric acid, 10 parts; myristic acid, 10 parts; $NaH_2PO_4.H_2O$, 15 parts $NaHCO_3$, 15 parts; KDCC, 10 parts; phthalocanine blue, 1 part.

These granules effervesce at a faster rate in water (at 100° F.) than granules made from a single fatty acid. The melting range of the mixture of lauric and myristic acids is about 34°-36° C.; the melting ranges of the individual acids are 41°-44° C. (for lauric acid) and 50°-54° C. (for myristic acid).

EXAMPLE 9

Using the procedure of Example 5, effervescent granules are made from each of the following two formulations:

| | A | B |
|---|---|---|
| $NaH_2PO_4 . H_2O$ | 5 | 5 |
| $NaHCO_3$ | 5 | 5 |
| Proteolytic enzyme preparation | 5 | 5 |
| Lauric diethanolamide ("varamide ML1") | 5 | |
| pentasodium tripolyphosphate (anhydrous) | | 5 |
| Lauric acid | | 7.5 |

Each of the products is mixed with the granular spray dried built commercial detergent described in Example 2, in such proportions that the mixture, in each case, contains 3% of the proteolytic enzyme preparation. In wash tests each such mixture shows improved detergent properties.

The proteolytic enzyme preparation is a powdered product sold by Premier Malt as "Protease L 423-6" having an assay of 60,000 PV units per gram.

EXAMPLE 10

Using the procedure of Example 5, effervescent granules are made from each of the following two formulations:

| | A | B |
|---|---|---|
| $NaHCO_3$ | 8 | 8 |
| $NaH_2PO_4 . H_2O$ | 4 | 4 |
| KDCC | 4 | |
| Lauric acid | 2 | |
| Myristic acid | 2 | |
| KBr | | 2 |
| Polyethylene glycol ("Carbowax 1000") | | 6 |

In the making of Formulation B, the polyethylene glycol is melted, and all the other ingredients are blended together and then added to the molten polyethylene glycol.

In each of the above Examples the percentage of effect material(s) in the effervescent granules is within the range of 0.4 to 26.8% of the weight of said granules. Also, the ingredients are supplied in finely divided (e.g. powdered) substantially anhydrous form unless otherwise noted.

It is understood that the foregoing detailed description is merely given by way of illustration and that many variations may be made therein without departing from the spirit of the invention. The "Abstract" given above is merely for the convenience of searchers and is not to be given any weight in defining the scope of the invention.

I claim:

1. A granular detergent mixture for washing fabrics, said mixture consisting essentially of (a) from 9-95 parts of non-effervescing granules of water soluble built detergent composition which have an apparent density of less than about 0.42 g./cc. and consist essentially of 0.5 to 10 parts of a water-soluble alkaline builder salt selected from the group consisting of sodium tripolyphosphate, potassium pyrophosphate, sodium hexametaphosphate, sodium carbonate, sodium bicarbonate, sodium sesquicarbonate and sodium tetraborate to one part of water soluble organic surface active detergent selected from the group consisting of sodium soaps of higher fatty acids of 12 to 22 carbon atoms, sodium higher linear alkyl benzene sulfonates having 10 to 16 carbon atoms in the alkyl group thereof, sodium olefin sulfonates of 12 to 21 carbon atoms in the olefin, sodium paraffin sulfonates of 10 to 20 carbon atoms in the paraffin, sodium higher fatty alcohol sulfates of 10 to 20 carbon atoms in the alcohol, sodium higher fatty alcohol polyethenoxy sulfates of 10 to 20 carbon atoms in the alcohol and of 1 to 5 ethenoxy groups, higher fatty alcohol-ethylene oxide condensation products and ethylene oxide-polypropylene glycol condensation products, and contain 3 to 13% moisture, and (b) 5-10 parts of effervescent granules which effervesce when said mixture is added to wash water used for the washing of the fabrics, said effervescent granules having a particle size in the range of about 0.2 to 3 mm. and consisting essentially of 0.4 to 26.8% of an effect material selected from the group consisting of enzymes selected from the group consisting of proteolytic enzymes and metalloproteases containing divalent ions bound in their protein chains, fluorescent brighteners of the stilbene sulfonate and oxazole types, bacteriostatic and bactericidal agents selected from the group consisting of halogenated carbanilides, halogenated salicylanilides, halogenated bisphenols, halogenated trifluoromethyldiphenyl urea and the zinc salt of 1-hydroxy-2-pyridinethione, and activators for sodium perborate selected from the group consisting of percarboxylic acid precursor esters, anhydrides and acyl amides and m-chlorobenzoyl dimethyl hydantoin, 5 to 50% of a fusible normally solid binder selected from the group consisting of higher fatty acids of 10 to 22 carbon atoms and mixtures thereof, 5 to 60% of a carbonate selected from the group consisting of sodium carbonate and sodium bicarbonate and 5 to 40% of a solid acidic material which is reactive with the carbonate to produce gas on contact with the wash water, said effervescent granules having been produced by forming a melt of said fusible higher fatty acids binder with said carbonate and said solid acidic material which is reactive with the carbonate to produce gas on contact with wash water, and said effect material, solidifying said mixture and forming granules from it, said effervescent granules, as such, in the absence of said built detergent composition, effervescing when placed in water at 37° C. and retaining their effervescing and effect material properties on storage of said granular detergent mixture.

* * * * *